US005479865A

United States Patent [19]

Cauffiel

[11] Patent Number: 5,479,865

[45] Date of Patent: Jan. 2, 1996

[54] TABLE WITH ELONGATE SUPPORT AND BASE PLATE FOR USE WITH SEATING APPARATUS

[76] Inventor: Ford B. Cauffiel, 4126 Nantucket Dr., Toledo, Ohio 43623

[21] Appl. No.: 102,916

[22] Filed: Aug. 6, 1993

Related U.S. Application Data

[63] Continuation-in-part of Ser. No. 950,142, Sep. 24, 1992, Pat. No. 5,293,825.

[51] Int. Cl.[6] ..... A47B 23/00

[52] U.S. Cl. ..... 108/42; 108/49

[58] Field of Search ..... 297/144, 135, 297/423.1, 423.39, 423.4, 170, 172; 108/42, 49, 144, 106; 248/188, 345.1

[56] References Cited

U.S. PATENT DOCUMENTS

| | | | |
|---|---|---|---|
| 2,582,703 | 1/1952 | Kirshbaum | 297/144 |
| 3,108,393 | 10/1963 | Baker | 248/345.1 |
| 3,127,114 | 3/1964 | Shaw | 100/49 X |
| 3,698,328 | 10/1972 | Weir | 108/49 X |
| 4,026,219 | 5/1977 | Shure et al. | 108/13 X |
| 4,779,540 | 10/1988 | Dion et al. | 108/98 |
| 5,009,379 | 4/1991 | Sadler | 108/49 X |
| 5,062,370 | 11/1991 | Etlinger | 108/51.1 X |
| 5,129,702 | 7/1992 | Ervin | 108/49 X |
| 5,144,898 | 9/1992 | Posly | 108/49 X |

*Primary Examiner*—Jose V. Chen
*Attorney, Agent, or Firm*—Allen D. Gutchess, Jr.

[57] ABSTRACT

A table assembly for use with seating apparatus has a base plate of sufficient size to fit under supports on at least one side of the seating apparatus and has an elongate member or post extending upwardly from a forward portion of the base plate to support an end, portion of a table. A linkage connects a lower surface of the table with the elongate member and the linkage can be manipulated to enable the table to be swung down along the side of the elongate member when not in use. The table can also pivot in a horizontal plane relative to the base plate to be swung to an out-of-the-way position. The elongate member or post can also be of telescoping design with a clamp for holding the table at a desired distance from the base plate for height adjustment. The base plate can also be in a prestressed, curved condition for greater stiffness. The elongate member can be received in or over a sleeve mounted on the base plate with the sleeve being adjustable to place the elongate member in a vertical position. Different thicknesses of rings can be located around the sleeve for height adjustment purposes also. Pads with projections can be located under the base plate for greater stability and one pad can be adjustable with an upstanding stop plate to prevent rearward movement of the seating apparatus. Further, the base plate can be wider to accommodate the wheels of a wheelchair.

11 Claims, 4 Drawing Sheets

TABLE WITH ELONGATE SUPPORT AND BASE PLATE FOR USE WITH SEATING APPARATUS

This application is a continuation-in-part of my application Ser. No. 07/950,142, filed on Sep. 24, 1992, now U.S. Pat. No. 5,293,825.

This invention relates to a table assembly for use with seating apparatus.

The table assembly can be separated completely from the seating apparatus for storage or for use with other seating apparatus. The seating apparatus can include chairs, wheelchairs sofas, love seats, and the like. The table assembly includes a base plate of sufficient size to fit under the front and back legs or other supporting structure on at least one side of the seating apparatus and is easy to remove. A lower supporting sleeve is affixed to a forward portion of the base plate and extends upwardly therefrom. An elongate member or post has a lower end removably received in or over the sleeve and can be separated therefrom.

A table of the TV type is supported by the post and base plate. The table can have a first U-shaped bracket affixed to the bottom of the table near one end thereof with two downwardly-extending flanges. A second U-shaped bracket has upwardly-extending flanges positioned adjacent the downwardly-extending ones. An upper sleeve is affixed to a web of the second bracket and extends downwardly through both the downwardly-extending flanges and the upwardly-extending ones to enable the two brackets to pivot relative to one another. The table can be pivoted in a horizontal plane to an out-of-the-way position when not in use.

If desired, linkage means can be connected between the bottom of the table or first bracket and manipulated to enable the table to be swung downwardly along side the elongate member or post so that the table can be swung to an out-of-the-way position when the table assembly is near a wall or other object.

The elongate member or post can be made in two sections one of which telescopes into the other. A clamp is mounted on the larger section and engages both sections when the table is at a desired height and a knob on the clamp is turned on a threaded stud extending outwardly from the larger section.

The base plate can be located on a pad or pads with downwardly-extending projections which provide a more stable base, particularly when the table assembly is used on a thicker carpet or rug. If two pads are employed, one can be located toward the rear of the base plate with an upwardly-extending stop plate which engages the rear leg or supporting structure of the seating apparatus. This prevents slipping of the seating apparatus when a person is sitting in or arising from the seating apparatus.

The base plate also can be stressed for greater stiffness. In one form, when the plate is made, it can be bent slightly along parallel lines and then assumes a flat condition when a flange is bent upwardly on the forward portion of the base plate. In another form, the base plate can have a bent bar affixed to a forward portion of the base plate to cause the forward plate to bend as the bar is affixed to the plate.

The lower end of the elongate member or post can be received in or over a sleeve which is mounted for adjustment on the base plate to place the post in a vertical position as needed.

It is, therefore, a principal object of the invention to provide a table assembly for use with seating apparatus having the features discussed above.

Various other objects and advantages of the invention will be apparent from the following detailed description of preferred embodiments thereof, reference being made to the accompanying drawings, in which.

Figure 1:
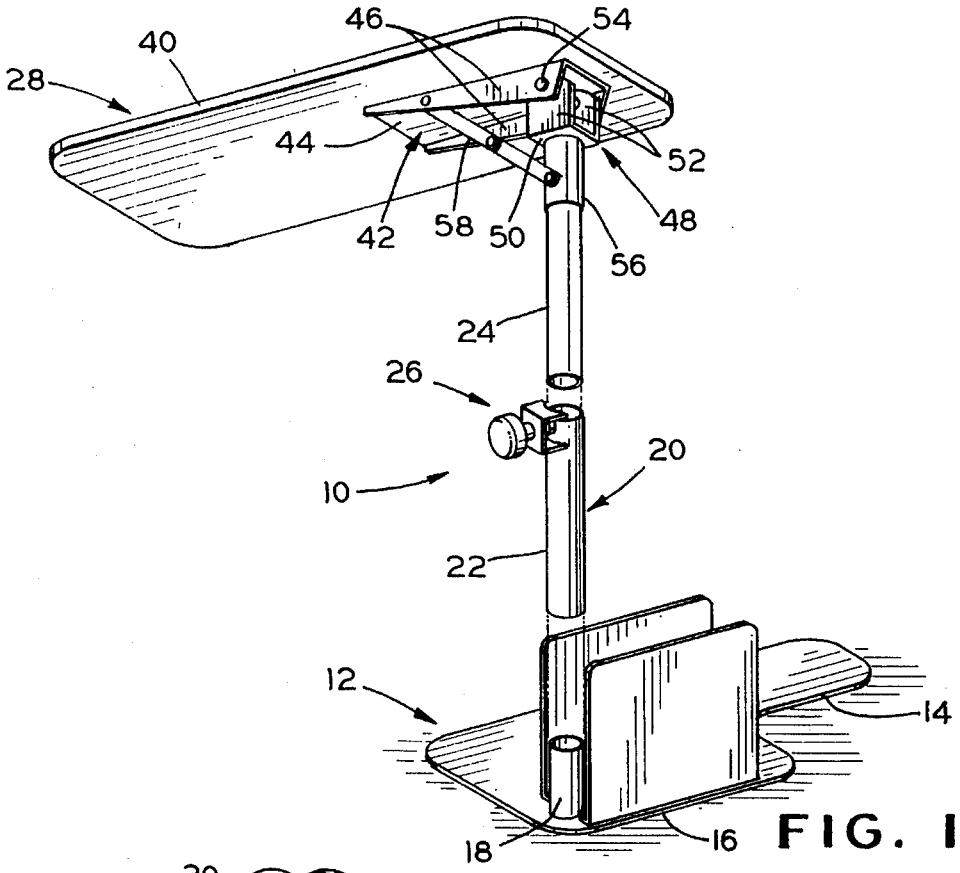
FIG. 1 is an exploded view in perspective of a table assembly in accordance with the invention.

Referring to the drawings, and particularly to FIG. 1, a TV table assembly in accordance with the invention is indicated at 10. It includes a base plate 12 of a sufficient size to be placed under seating apparatus supports on one side of seating apparatus. The seating apparatus can include chairs, sofas, loveseats and wheelchairs, by way of example. However, for wheelchairs, it is preferred that the plate be wide enough to receive both rear wheels of the wheelchair. An assembly specifically for "wheelschairs" will be shown and described subsequently. The seating apparatus supports can be front and rear legs or runners that extend the full length of the seating apparatus. In any event, the base plate is supported and held in position by at least one side of the seating apparatus. More "specifically" the base plate 12 includes a narrow rear portion 14 extending rearwardly from a front wide portion 16. A lower sleeve or cylinder 18 extends upwardly from an outer forward portion of the wide portion 16 of the base plate 12. It can be affixed to the base plate 12 by any suitable means such as a threaded fastener and bolt (not shown) or by welding.

Figure 2:
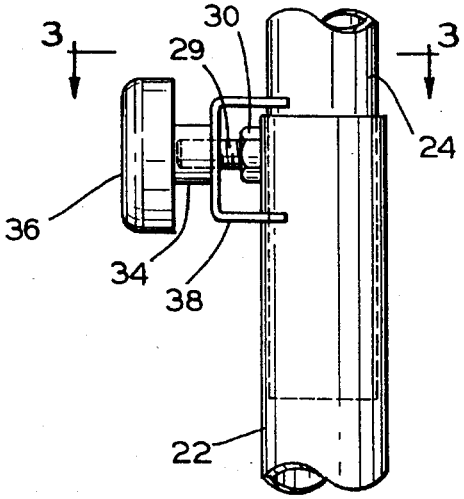
FIG. 2 is a fragmentary view in elevation of a two-section elongate member for the base plate and table of FIG. 1 with a clamping arrangement to provide a height adjustment for the table.
Figure 3:
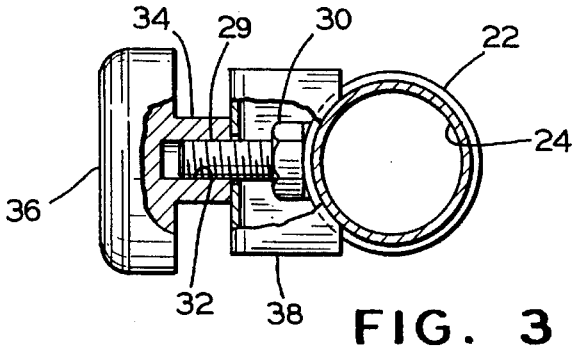
FIG. 3 is a view in cross section, taken along the line 3—3 of FIG. 2, with parts broken away.

An upright supporting post 20 has a lower section 22 and a telescoping, upper section 24. The lower end of the section 22 is removably received in or over the cylinder 18 and can pivot relative thereto as well as be removed. The lower end of the upper section 24 of the post 20 telescopes into the lower section 22, as shown in FIGS. 2 and 3, and is held in place by a clamp 26 when a table 28 at the upper end of the post 20 is at a desired height or distance from the base plate 12.

The clamp 26 includes a threaded stud 29 affixed to an upper end of the post section 22 by welding through a base nut 30. The threaded stud 29 is threadedly received in a bore 32 of a shank 34 of an adjusting knob 36. A generally C-shaped clamping plate 38 has concave edges which engage the upper end of the post section 22 and a lower portion of the post section 24 when in a desired position. The adjusting knob 36 is turned to tighten the clamping plate against the post sections and hold them firmly in position.

An elongate panel 40 of the table 28 is supported on the post 20 and is of ample size and strength to comfortably hold and support food and refreshment, being thirteen inches wide and thirty-one inches long, by way of example. The table panel 40 can be of wood with an attractive finish thereon. A supporting bracket 42 is located at an end portion of the table 28. It has a web 44 which is suitably affixed to the bottom surface of the table panel 40 by threaded fasteners (not shown) and has tapered side flanges 46. A U-shaped bracket 48 has a web 50 with upwardly-extending, parallel flanges 52. The flanges 46 and 52 are pivotally connected by a suitable pin 54. The web 50 of the bracket 48 has a sleeve 56 extending downwardly therefrom and received over the upper end of the post section The sleeve 56 can pivot relative to the post section 24 and can be removed therefrom, if desired.

The pivotal arrangement of the brackets 42 and 48 enable is the table panel 40 to be pivoted downwardly about the pin 54 to a position in which the table is substantially parallel to the supporting post 20. The table, as it is swung downwardly, can also be pivoted to an out-of-the-way position. This enables the table to be moved to an out-of-the-way position when the table assembly 10 is located near a wall or other object.

When the table 28 is in the horizontal position for use, it can be held in that position by over-center linkages 58 which are of the type used commonly with card table legs. The linkage can be moved to a locking position automatically when the table is moved to a horizontal position and then pulled downwardly at the center pivot point when the table is to be pivoted downwardly.

Figure 4:
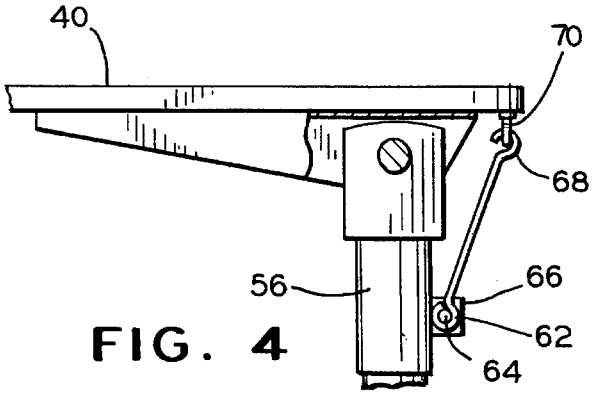
FIG. 4 is a fragmentary side view in elevation of a modified connection between the elongate member and table of FIG. 1.

In another form, a hook and eye linkage shown in FIG. 4 can be used to hold the table 28 in a horizontal position. In this instance, the linkage includes a hook 60 having a loop 62 which is pivotally connected by a pin 64 to a bracket 66 affixed to and extending outwardly from the sleeve 56. A hook end 68 can be engaged with a loop 70 affixed to the bottom of the table panel 40 when the table is in the horizontal position. The hook linkage 60 can then be disengaged from the loop 70 when the table is to be pivoted downwardly.

Figure 5:
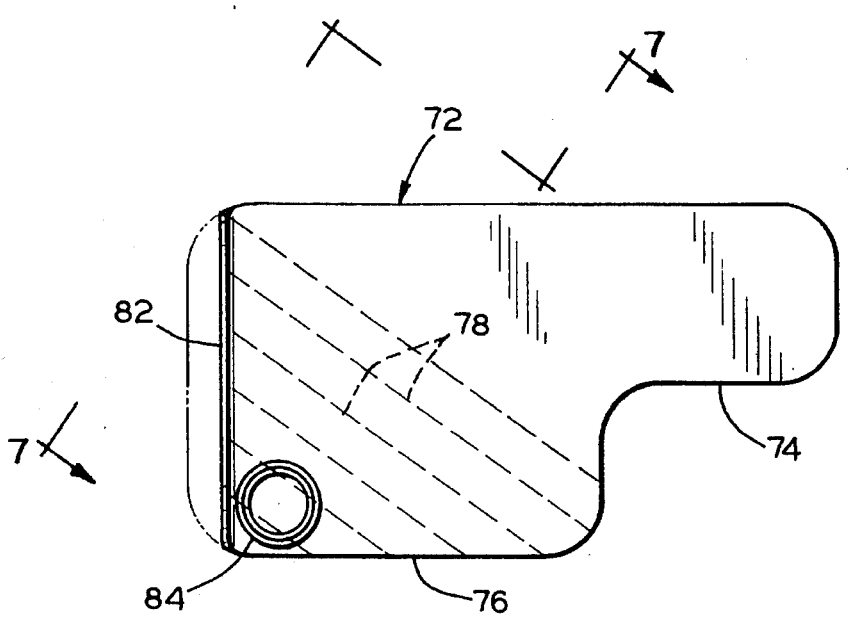
FIG. 5 is a plan view of a base plate in a prestressed condition.
Figure 6:
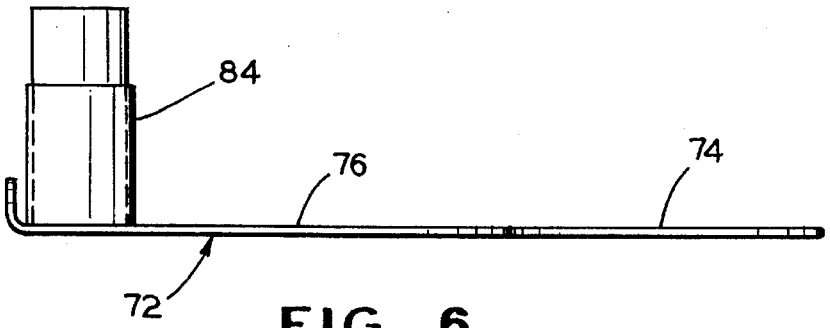
FIG. 6 is a somewhat larger side view of the base plate of FIG. 5.
Figure 7:
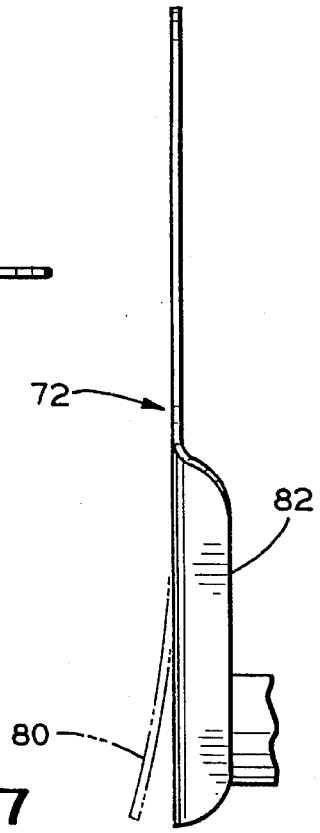
FIG. 7 is an end view taken along the lines 7—7 of FIG. 8, showing the plate in dotted lines before the flange is bent up at the end thereof.

It has been found that the base plate, which is commonly made of ten gauge steel, can be placed in a prestressed condition for greater stiffness. Referring to FIGS. 5–7, a base plate 72 is generally of the same shape as the base plate 12, having a narrow rear portion 74 and a wider front portion 76. The wider front portion 76 can be bent along diagonal bend lines indicated by dotted lines 78 to assume an initial condition shown in dotted lines 80 in FIG. 7. A front flange 82 is then bent upwardly perpendicular to the longitudinal extent of the base plate 72 and extending the width of the wide portion 76. This places the plate in a flat, prestressed condition and provides greater stiffness particularly for the outer portion where a supporting sleeve or cylinder 84 extends upwardly from the base plate.

Figure 8:
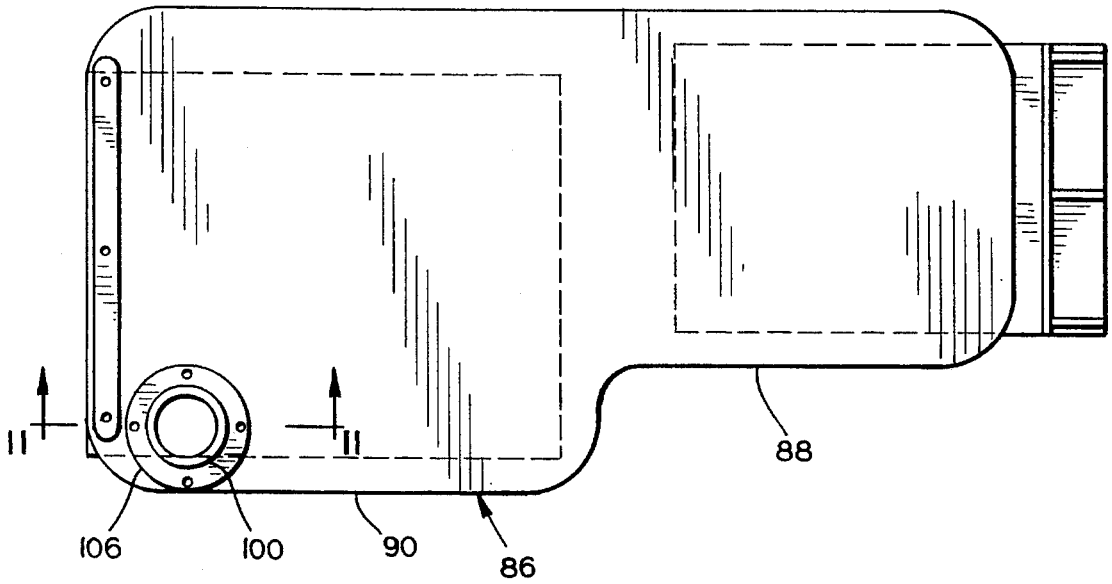
FIG. 8 is a plan view of a base plate which can be used on either side of seating apparatus.
Figure 9:
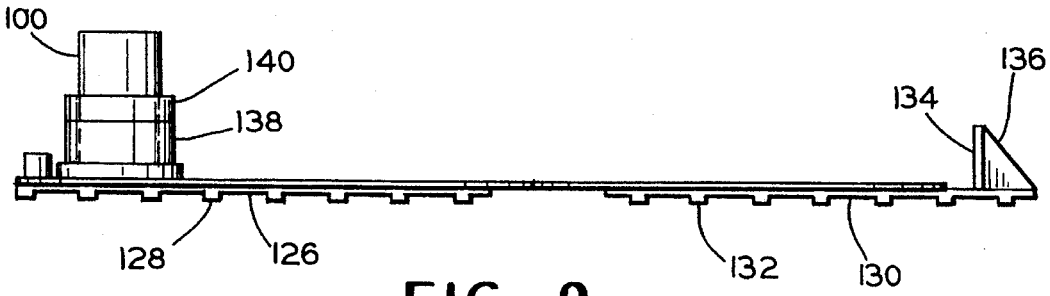
FIG. 9 is a side view in elevation of the base plate of FIG. 8.
Figure 10:
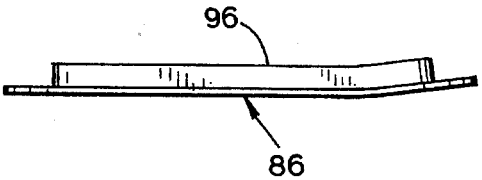
FIG. 10 is an end view of the base plate of FIG. 8.
Figure 11:
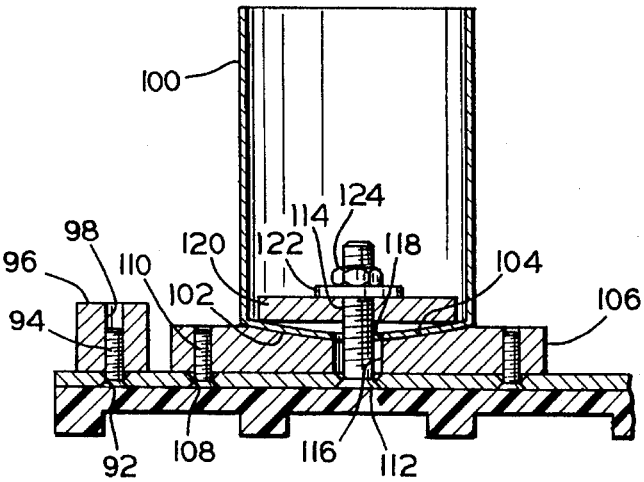
FIG. 11 is an enlarged view in section taken along the lines 11—11 of FIG. 8.

Referring to FIGS. 8–11, another prestressed base plate is shown which can be used on either side of the seating apparatus. A base plate 86 is similar in configuration to the previous two described including a narrower rear portion 88 and a wider front portion 90. The forward portion of the base plate 86 has three double tapered, holes 92 to receive tapered, flat-headed fasteners 94. A bent stress bar 96 has three threaded bores 98 to receive the fasteners 94 to affix the bar 96 firmly to the base plate 90. When so fastened, the forward portion of the base plate 86 is curved to a bent, stressed condition as shown in FIG. 10. This again adds stiffness to the base plate. For the base plate 86 to be used at the opposite side of the seating apparatus, the base plate 86 is turned over, and the stress bar 96 is turned end for end and fastened to the base plate as before, to place the base plate in a curved, stressed condition toward the outer edge thereof.

A mounting sleeve 100 has a curved lower surface 102 which S is received in a curved recess 104 in a mounting plate 106. The mounting plate 106 is affixed to the base plate through four double tapered holes 108 by four threaded fasteners 110 and can be mounted on either side of the plate 86 in the same manner as the stress bar 96. A larger double tapered hole 112 receives a larger flat-headed fastener 114 which extends upwardly through a large central hole 116 in the mounting plate 86 and through a hole 118 in the curved bottom 102 of the sleeve 100. The fastener 114 also extends through a circular plate 120, a washer 122, and a nut 124. The nut 124 can be tightened against the washer and plate 120 when the sleeve 100 is in a desired upright position to receive a mounting post similar to the post 20, for example.

As shown in FIGS. 8 and 9, the wide portion 90 of the plate 86 can have a plastic pad 126 thereunder with projections 128. The projections 128 can penetrate a thicker rug more effectively to provide a more stable support for the base plate. The base plate 86 can also have a narrower plastic pad 130 with projections 132 for the same purpose. In this case, the pad 130 has a stop plate 134 extending upwardly therefrom with supporting gussets 136. The plate 130 can be adjusted longitudinally to place the stop plate 134 against the rear supporting structure of the seating apparatus. This prevents slipping of the seating apparatus when a person sits in or rises therefrom.

For height adjustment purposes, rings such as rings 138 and 140 of FIG. 9 can be placed over the sleeve 100 to abut the lower end of a supporting post placed over the sleeve. The rings can come in thicknesses of one inch, two inches, and three inches, for example, to provide multiple heights according to the rings being used.

Figure 12:
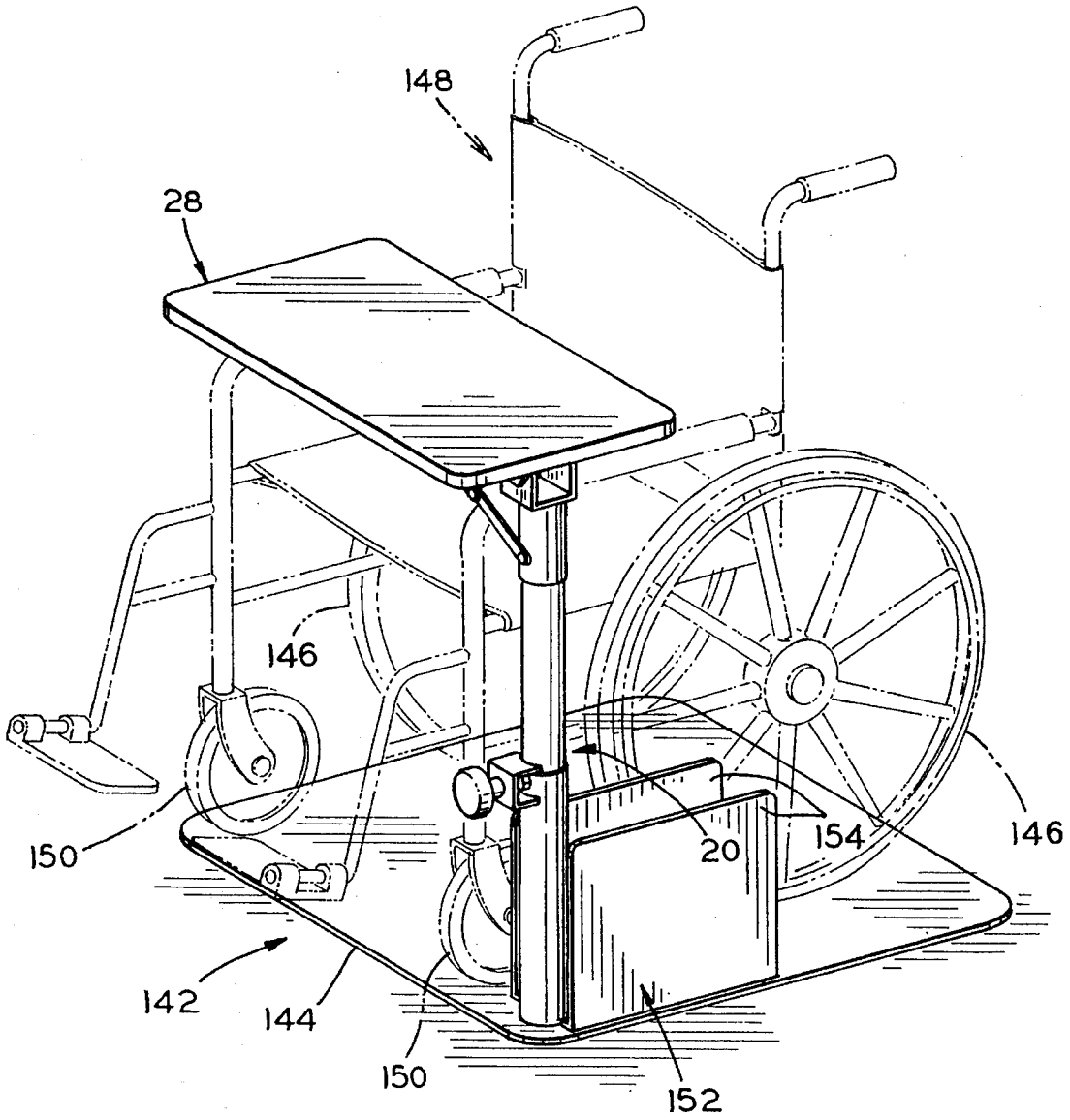
FIG. 12 is a view in perspective of another table assembly with a wider base plate for use with a wheelchair, which is shown in dotted lines.

A table assembly for wheelchairs is indicated at 142 in FIG. 12. It includes a base plate 144 which is wide enough to receive both rear wheels 146 of a wheelchair 148. The base plate 144 also is preferably of sufficient size to receive both front caster wheels 150 of the wheelchair. The supporting posts and height adjustment can be similar to those of FIG. 1 and the table can be swung to an out-of-the-way position by the post 20 being pivoted relative to a lower sleeve corresponding to the sleeve 18 of FIG. 1. If desired, the table 28 of FIG. 12 can be pivoted downwardly in the same manner as FIGS. 1–3 or FIG. 4.

In this instance, the table assembly 142 can also have a magazine rack 152 on the base plate 144. This consists of two panels 142 extending upwardly on either side of the supporting post 20 and suitably affixed to the base plate 144.

Various modifications to the above-described embodiments of the invention will be-apparent to those skilled in the art, and it is to be understood that such modifications can be made without departing from the scope of the invention, if they are within the spirit and the tenor of the accompanying claims.

I claim:

1. An assembly for use under either side of seating apparatus having two sides for supporting a table and a post, said assembly comprising a base plate of sufficient size to be received under supporting structure on either side of said seating apparatus for supporting the table and post, said base plate having two sides, a sleeve to receive the post, a mounting base to receive said sleeve, said mounting base and said base plate having fastener means for mounting said base plate and said sleeve on an outer edge portion on either side of said base plate.

2. An assembly according to claim 1 wherein said fastener means comprises double-beveled holes in said base plate and fasteners with flat heads to be received through said holes and be flush with an upper side of said base plate opposite said mounting base.

3. An assembly according to claim 1 wherein said mounting base has a concave upwardly-facing surface and said sleeve has a convex downwardly-facing surface mating with said concave surface, and means to fasten said sleeve to said mounting plate at angular positions.

4. An assembly according to claim 1 wherein an elongate bar is provided, and fasteners to affix said bar to a forward portion of said base plate on either side thereof.

5. An assembly according to claim 4 wherein said bar has a curved end which causes an outer portion of said base plate to curve upwardly slightly when said bar is fastened to said base plate.

6. An assembly according to claim 5 wherein said bar has rounded ends and fastener-receiving means to enable said bar to be fastened to an upper side of said base plate.

7. An assembly according to claim 1 wherein there are at least two spacing rings of different thicknesses which can fit over said sleeve to adjust the height of the table.

8. A table assembly for use with seating apparatus, said assembly comprising stabilizing means defined by a base plate to be received under and held stationary by seating apparatus supports on at least one side of said seating apparatus for supporting said assembly, said base plate having a bottom surface for defining a floor-engaging means contacting a floor under the seating apparatus, said base plate being bent along a plurality of angular lines prior to assembly to cause at least an outer portion of said base plate to be in a prestressed condition, upright post means, first means on said base plate to support a lower end of said post means on said plate, a table, second means connecting an upper end of said post means to an end portion of said table, and said table being moveable in a horizontal plane relative to said base plate.

9. A table assembly according to claim 8 wherein a forward edge portion of said base plate has a flange extending upwardly therefrom across the width of said base plate.

10. A table assembly for use with seating apparatus, said assembly comprising stabilizing means defined by a base plate to be received under and held stationary by seating apparatus supports on at least one side of said seating apparatus for supporting said assembly, said base plate having a bottom surface for defining a floor-engaging means contacting a floor under the seating apparatus, upright post means comprising upper and lower telescoping sections, first means on said base plate to support a lower end of said lower section on said plate, a table, second means connecting an upper end of said upper section to an end portion of said table, hand-operated means to hold said upper and lower telescoping sections in a predetermined position so that the table is at a predetermined distance from said base plate, said table being pivotal in a horizontal plane relative to said base plate, a pad having downwardly-extending projections located under said base plate, a second pad having projections located under a rear portion of said base plate, said second pad having a stop plate on a rear portion thereof extending upwardly and capable of adjustment to contact a rear portion of said supporting structure.

11. A table assembly for use with seating apparatus, said assembly comprising stabilizing means defined by a base plate to be received under and held stationary by seating apparatus supports on at least one side of said seating apparatus for supporting said assembly, said base plate having a bottom surface for defining a floor-engaging means contacting a floor under the seating apparatus, upright post means comprising upper and lower telescoping sections, first means on said base plate to support a lower end of said lower section on said plate, a table, second means connecting an upper end of said upper section to an end portion of said table, hand-operated means to hold said upper and lower telescoping sections in a predetermined position so that the table is at a predetermined distance from said base plate, said table being pivotal in a horizontal plane relative to said base plate, said base plate being bent along a plurality of angular lines prior to assembly to cause at least an outer portion of said base plate to be in prestressed condition.

* * * * *

UNITED STATES PATENT AND TRADEMARK OFFICE

CERTIFICATE OF CORRECTION

PATENT NO. : 5,479,865

DATED : January 2, 1996

INVENTOR(S) : Ford B. Cauffiel

It is certified that error appears in the above-identified patent and that said Letters Patent is hereby corrected as shown below:

Column 1, lines 11-12, after "wheelchairs" insert --,--.

Column 2, line 38, delete " " around "wheelchairs".

Column 2, line 43, delete " " around "specifically".

Column 3, line 14, after "section" insert --24--.

Column 3, line 61, after "tapered" delete --,--.

Column 4, line 7, delete "S".

Column 4, line 54, replace "be-apparent" with --be apparent--.

Signed and Sealed this

Fifth Day of March, 1996

Bruce Lehman

*Attest:*

BRUCE LEHMAN

*Attesting Officer*

*Commissioner of Patents and Trademarks*